US006094864A

United States Patent [19]

Hsu

[11] Patent Number: 6,094,864

[45] Date of Patent: Aug. 1, 2000

[54] DOOR/WINDOW FRAME STRUCTURE

[75] Inventor: Pey Son Hsu, Changhua Hsien, Taiwan

[73] Assignee: Ching Feng Blinds Ind. Co. Ltd., Taiwan

[21] Appl. No.: 09/349,725

[22] Filed: Jul. 8, 1999

[51] Int. Cl.[7] ..... E06B 7/096

[52] U.S. Cl. ..... 49/82.1

[58] Field of Search ..... 49/74.1, 82.1; 454/221, 224, 278

[56] References Cited

U.S. PATENT DOCUMENTS

| | | | |
|---|---|---|---|
| 2,607,452 | 8/1952 | Hall | 49/82.1 X |
| 2,903,257 | 9/1959 | Perrone | 49/82.1 |
| 3,201,832 | 8/1965 | Hordis et al. | 49/82.1 X |

*Primary Examiner*—Jerry Redman
*Attorney, Agent, or Firm*—Bacon & Thomas PLLC

[57] ABSTRACT

A door/window frame structure including two lateral columns. Several slats are disposed between the two lateral columns. Each lateral column is a U-shaped body. One side of the surface of the lateral column is formed with a row of through holes corresponding to the slats. Two inner side walls of the lateral column are respectively formed with a rib. One of the side walls is disposed with two parallel stopper walls between which a rack is mounted. An inner side of each through hole is disposed with a T-gear meshing with the rack. The T-gear is formed with a central rectangular hole. One side of each slat is disposed with a shaft rod having a rear rectangular post passed through each through hole of the lateral column to insert into the rectangular hole of the T-gear. A cover board is mated with the lateral column. One side of the cover board is disposed with two parallel latch ribs and an outer side of each latch rib is formed with a latch channel. When covering the open side of the U-shaped lateral column, the ribs of the lateral column are just engaged and latched in the latch channels. A lower section of the other side wall of the lateral column is formed with a rectangular perforation. A rotary wheel engaged with the rack partially protrudes out of the perforation. The rotary wheel is formed with a central rectangular hole in which a shaft pin is inserted. The rotary wheel can be rotated on outer side to drive the rack which further drives each T-gear to rotate so as to drive each slat. The door/window frame can be assembled without using any tool and the angle of the slats can be synchronously adjusted.

1 Claim, 2 Drawing Sheets

DOOR/WINDOW FRAME STRUCTURE

BACKGROUND OF THE INVENTION

The present invention relates to a door/window frame structure including two lateral columns. Several slats are disposed between the two lateral columns. Each slat has a shaft rod at rear end inserted into a rectangular hole of a T-gear which meshes with a rack. A rotary wheel partially protruding out of a lower end of the lateral column drives the rack to move up and down. The rack further drives each T-gear to rotate so as to drive each slat. Accordingly, the door/window frame can be quickly and easily assembled without using any tool. In addition, the angle of the slats can be synchronously adjusted to adjust the ventilation effect.

When installing slats on a conventional door/window frame, no matter the slats are fixed type or movable type, the assembling procedure is complicated and must be done with tools. With respect to the angle-adjustable slats, the slats must be adjusted one by one. Such procedure is troublesome.

SUMMARY OF THE INVENTION

It is therefore a primary object of the present invention to provide a door/window frame structure including two lateral columns. Several slats are disposed between the two lateral columns. Each lateral column is a U-shaped body in which a rib and two parallel stopper walls are disposed. A T-gear is disposed in the lateral column and meshes with a rack disposed between the stopper walls. A cover board is mated with the lateral column. One side of the cover board is disposed with two parallel latch ribs and an outer side of each latch rib is formed with a latch channel. When covering the open side of the U-shaped lateral column, the ribs of the lateral column are just engaged and latched in the latch channels. A lower section of the other side wall of the lateral column is formed with a rectangular perforation. A rotary wheel engaged with the rack partially protrudes out of the perforation. The door/window frame can be easily and quickly assembled without using any tool and the angle of the slats can be synchronously adjusted.

The present invention can be best understood through the following description and accompanying drawings wherein:

DETAILED DESCRIPTION OF THE PREFERRED EMBODIMENT

Figure 1:
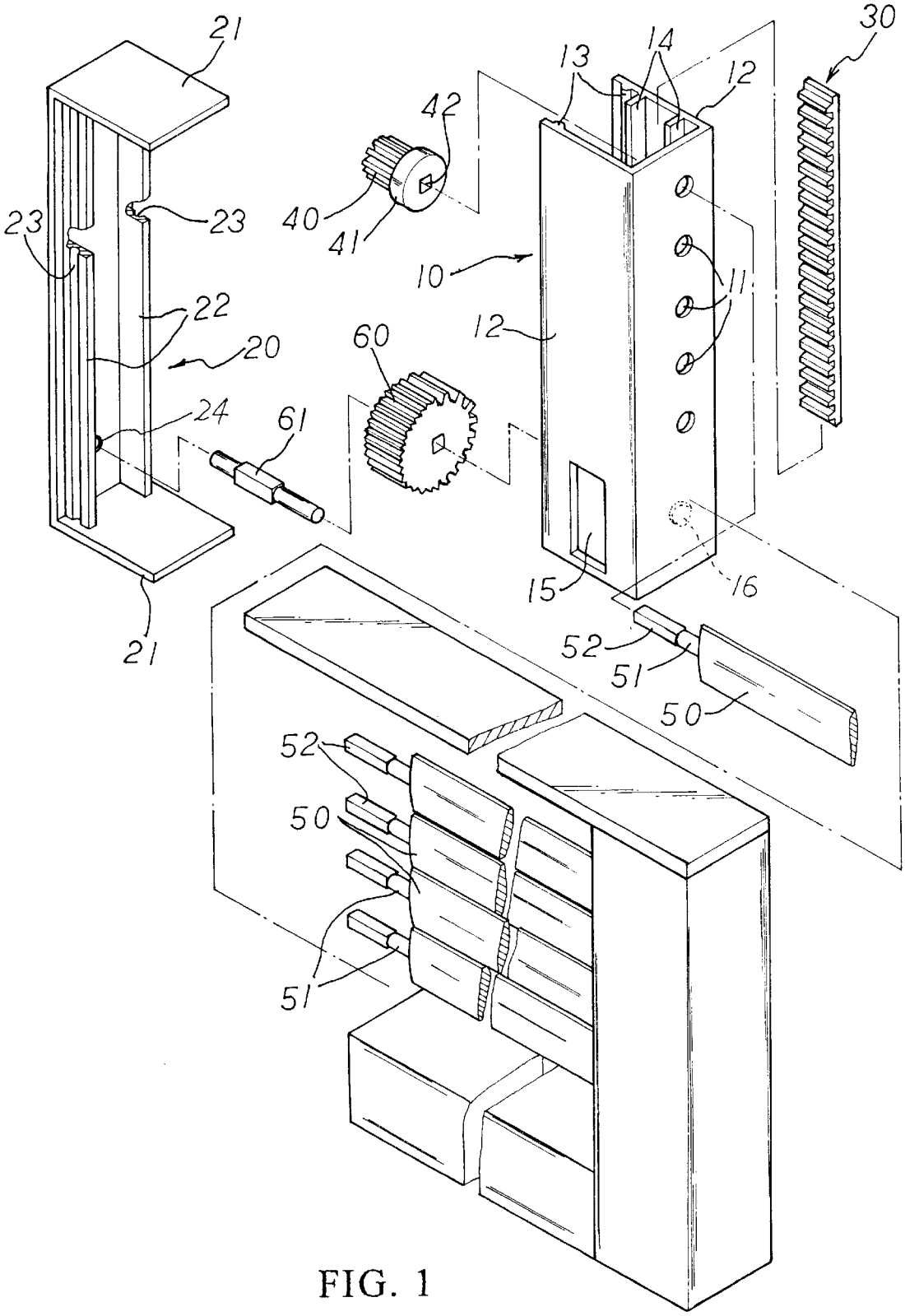
FIG. 1 is a perspective exploded view of the present invention.

Please refer to FIG. 1. Several slats 50 are disposed between two lateral columns 10 of a door/window frame. The lateral column 10 is an integrally molded U-shaped body. One side of the surface of the lateral column 10 is formed with a row of through holes 11 which are longitudinally arranged corresponding to the slats 50. The two inner side walls 12 are respectively formed with a rib 13. One of the side walls is disposed with two parallel stopper walls 14 between which a rack 30 is mounted. The rack 30 has a width slightly smaller than the distance between the stopper walls and is restricted to vertically move between the stopper walls. An inner side of each through hole 11 is disposed with a T-gear 40 meshing with the rack 30. One end of the T-gear 40 is disposed with an enlarged flange 41 positioned between the stopper wall 14 and the inner surface of the lateral column 10 for preventing the gear 40 from moving left or right. The center of the gear 40 is formed with a rectangular hole 42 corresponding to the through hole 11 of the surface of the lateral column 10. One side of each slat 50 is disposed with a shaft rod 51 having a rear rectangular post 52 passed through each through hole 11 of the lateral column 10 to insert into the rectangular hole 42 of the T-gear 40.

Figure 2:
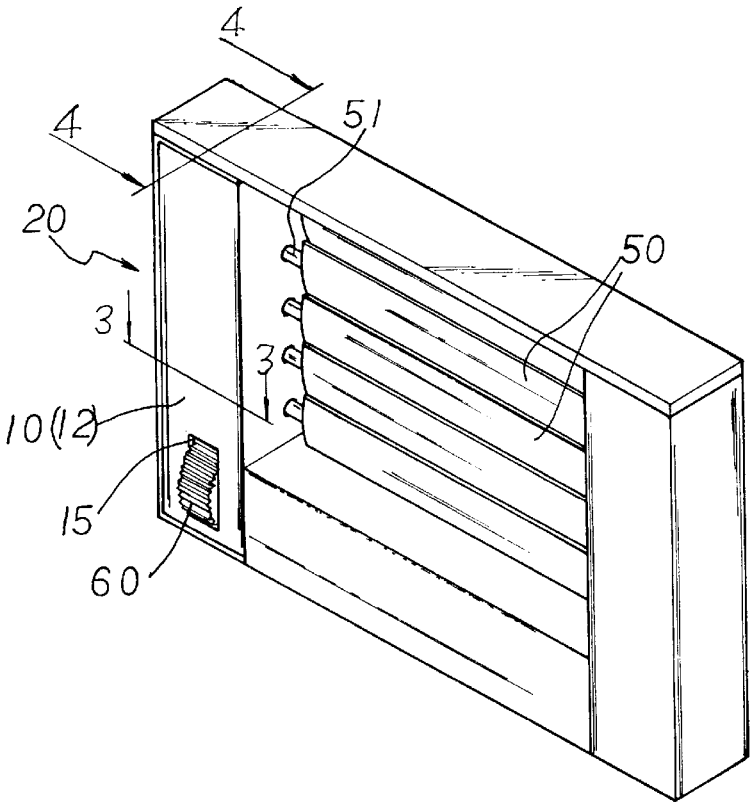
FIG. 2 is a perspective assembled view of the present invention.

A cover board 20 is mated with the lateral column 10. An upper and a lower ends of the cover board 20 are disposed with an upper and a lower covers 21 extending from one side thereof. This side is disposed with two parallel latch ribs 22 corresponding to the lateral column 10. The outer side of the latch rib 22 is formed with a latch channel 23. When covering the open side of the U-shaped lateral column 10, the ribs 13 of the lateral column 10 are just engaged and latched in the latch channels 23. A lower section of the other side wall 12 of the lateral column 10 is formed with a rectangular perforation 15. A rotary wheel 60 engaged with the rack 30 partially protrudes out of the perforation 15. The center of the rotary wheel 60 is formed with a rectangular hole in which a shaft pin 61 is inserted. A middle section of the shaft pin 61 is a rectangular section and two ends of the shaft pin 61 are cylindrical rods respectively inserted into the circular sockets 16, 24 formed on lower sections of inner surfaces of the lateral column 10 and the cover board 20 to form a structure as shown in FIG. 2.

Figure 4:
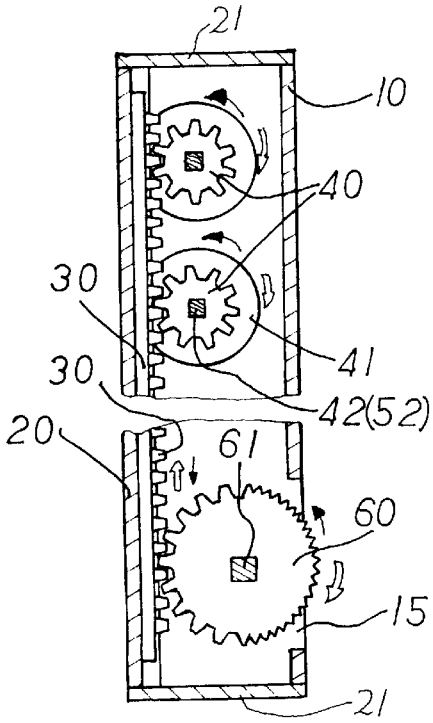
FIG. 4 is a sectional view taken along line 4—4 of FIG. 2.
Figure 3:
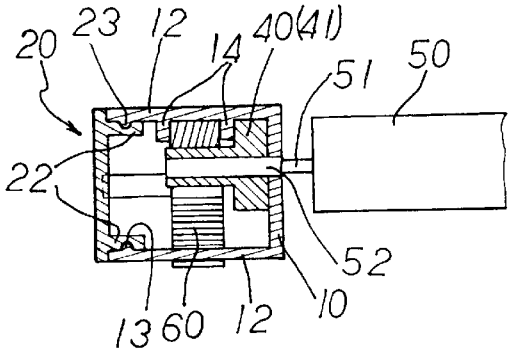
FIG. 3 is a sectional view taken along line 3—3 of FIG. 2.

Please refer to FIGS. 3 and 4 which show the internal structure of the lateral column and the adjustment of the slats. The rotary wheel 60 can be rotated on outer side to drive the rack 30 to move up and down. The rack 30 further drives each gear 40 to rotate so as to drive each slat 50 the shaft rod 51 of which is inserted in the central rectangular hole 42 of the gear 40. Accordingly, the window/door frame can be quickly and easily assembled without using any tool. In addition, the angle of the slats can be synchronously adjusted to adjust the ventilation effect.

The above embodiment is only used to illustrate the present invention, not intended to limit the scope thereof. Many modifications of the above embodiment can be made without departing from the spirit of the present invention.

What is claimed is:

1. A frame structure comprising two lateral columns, several slats being disposed between the two lateral columns, a rotary adjustment device being disposed in one lateral column for changing the angle of the slats and adjusting the ventilation effect, said frame structure being characterized in that:

each lateral column is an integrally molded U-shaped body, one side of the surface of the lateral column being formed with a row of through holes which are longitudinally arranged corresponding to the slats, two inner side walls of the lateral column being respectively formed with a rib, one of the side walls being disposed with two parallel stopper walls between which a rack is mounted, an inner side of each through hole being disposed with a T-gear meshing with the rack, one end of the T-gear being disposed with an enlarged flange positioned between one of the stopper walls and the inner surface of the lateral column, a center of the gear being formed with a rectangular hole corresponding to the through hole of the lateral column, one side of each slat being disposed with a shaft rod having a rear rectangular post passed through each through hole of the lateral column to insert into the rectangular hole of the T-gear; and a cover board is mated with the lateral column, an upper and a lower ends of the cover board being disposed with an upper and a lower covers extending from one side thereof, said one side of the cover board being disposed with two parallel latch ribs corresponding to the lateral column, an outer side of the latch rib being formed with a latch channel, whereby when covering an open side of the U-shaped lateral column, the ribs of the lateral column are just engaged and latched in the latch channels, a lower section of the other side wall of the lateral column being formed with a rectangular perforation, a rotary wheel engaged with the rack partially protruding out of the perforation, a center of the rotary wheel being formed with a rectangular hole in which a shaft pin is inserted, a middle section of the shaft pin being a rectangular section and two ends of the shaft pin being cylindrical rods respectively inserted into circular sockets formed on lower sections of inner surfaces of the lateral column and the cover board.

* * * * *